US006523308B1

(12) United States Patent
Gillispie

(10) Patent No.: US 6,523,308 B1
(45) Date of Patent: Feb. 25, 2003

(54) ROTATING-COVER STORAGE SHED

(75) Inventor: John G. Gillispie, Glen Dale, WV (US)

(73) Assignee: Eagle Manufacturing Company, Wellsburg, WV (US)

( * ) Notice: Subject to any disclaimer, the term of this patent is extended or adjusted under 35 U.S.C. 154(b) by 6 days.

(21) Appl. No.: 09/927,807

(22) Filed: Aug. 10, 2001

(51) Int. Cl.[7] ..... E04B 1/346

(52) U.S. Cl. ..... 52/67; 52/79.1; 52/79.4; 52/64; 52/66; 422/292

(58) Field of Search ..... 52/79.1, 79.4, 52/64, 66, 67; 150/52; 422/292

(56) References Cited

U.S. PATENT DOCUMENTS

| | | | | |
|---|---|---|---|---|
| D228,906 S | | 10/1973 | Terlesky | D23/1 |
| 3,828,492 A | | 8/1974 | Schliemann et al. | 52/36 |
| 3,899,854 A | | 8/1975 | Huddle | 52/80 |
| 4,106,520 A | | 8/1978 | Warner et al. | 135/4 |
| 4,306,390 A | * | 12/1981 | Brown | 52/67 |
| 4,974,376 A | * | 12/1990 | Nielsen | 52/79.1 |
| D325,979 S | | 5/1992 | Mahler | D25/33 |
| D340,531 S | | 10/1993 | Starkey | D25/33 |
| 5,285,617 A | * | 2/1994 | Roming et al. | 52/745.01 |
| D423,179 S | | 4/2000 | Horner et al. | D34/38 |
| 6,052,951 A | * | 4/2000 | Daoud | 52/64 |
| D426,314 S | | 6/2000 | Girard et al. | D25/33 |
| 6,151,840 A | * | 11/2000 | Simison | 52/67 |

* cited by examiner

*Primary Examiner*—Carl D. Friedman
*Assistant Examiner*—Nahid Amiri
(74) *Attorney, Agent, or Firm*—Armstrong, Westerman & Hattori, LLP

(57) ABSTRACT

A rotating-cover storage shed for storing drums of material which is potentially hazardous to the environment. The shed provides a means for containing any leaking material and also provides for protection from the weather and from unauthorized access to the stored contents. Access to the contents is easily made by rotatably opening one of a pair of rotating cover sections.

11 Claims, 5 Drawing Sheets

ROTATING-COVER STORAGE SHED

FIELD OF THE INVENTION

The present invention is a storage shed for storing material, contained in drums, which could present an environmental hazard if leakage of the material from one or more of the drums were to occur. The shed provides for containment of leaking material, protection of the drums from weather, easy access to all of the stored drums and security from unauthorized access or use of the drums.

BACKGROUND OF THE INVENTION

Storage of materials which are potentially hazardous to the environment or to personnel within the workplace is regulated by various governmental agencies, and is of concern to business-insurance carriers and corporate safety personnel.

Many industrial and commercial materials, most being liquids, are contained in plastic or metal drums for the convenience of shipping, storing, and use. A "55 gallon drum" has evolved as a standard size for storage of most liquids, although smaller capacity drums are utilized for certain applications. The invention of the present application is disclosed with reference to storage of 4 of those standard drums, however, storage of drums of another size or modification of the capacity of the storage shed is not ruled out by the present invention.

An important component of a drum storage system is a means for containing material which might leak from the drums being stored. Many drum storage pallets are known which provide for the containment of material in the event of leakage from one or more of the stored drums. Regulations, referred to above, specify the capacity required in relation to the storage capacity of the storage pallet. A drum storage pallet which can be used as a component of the present invention is described in U.S. Pat. No. 5,307,931 entitled "Hazardous Material Spill Skid", dated May 3, 1994, which is assigned to the assignee of the present invention and the contents of which are incorporated herein by reference.

In addition to providing the required containment means when hazardous materials are being stored, it is often desirable to provide protection for the drums from the elements, when storage is in an area unprotected from the weather. Also, it is desirable to limit unauthorized access to the stored material in both indoor and outdoor storage areas.

The present invention provides for the above requirements as well as providing other features and conveniences described below.

OBJECTS OF THE INVENTION

It is an object of the present invention to provide a structure for storing, in an environmentally safe manner, potentially hazardous materials which are contained in drums.

It is another object of the present invention to provide protection for stored drums from the elements, when outdoor storage is carried out.

It is still another object of the present invention to provide secure storage for stored drums, when protection from unauthorized access is desired.

SUMMARY OF THE INVENTION

The present invention has a rectangular support surface, for supporting a plurality of drums which contain a liquid which is potentially hazardous to the environment. The drums are stored with an upright orientation. Positioned below the support surface is a tray for containing any liquid which might leak from one or more of the drums. A rotatably openable cover encloses the drums, and is supported by the tray. The cover has two rotatable sections which are configured to pivot one section on the other section and to have a telescoping arrangement. When one of the sections is rotatably opened, the opened section is supported by the remaining section which remains closed. Access to the drums is available from the directions of two opposed edges of the rectangular support surface.

DESCRIPTION OF THE DRAWINGS

The invention will be more readily apparent from the following description of preferred embodiments thereof shown, by way of example only, in the accompanying drawings, wherein.

DETAILED DESCRIPTION OF THE INVENTION

Figure 1:
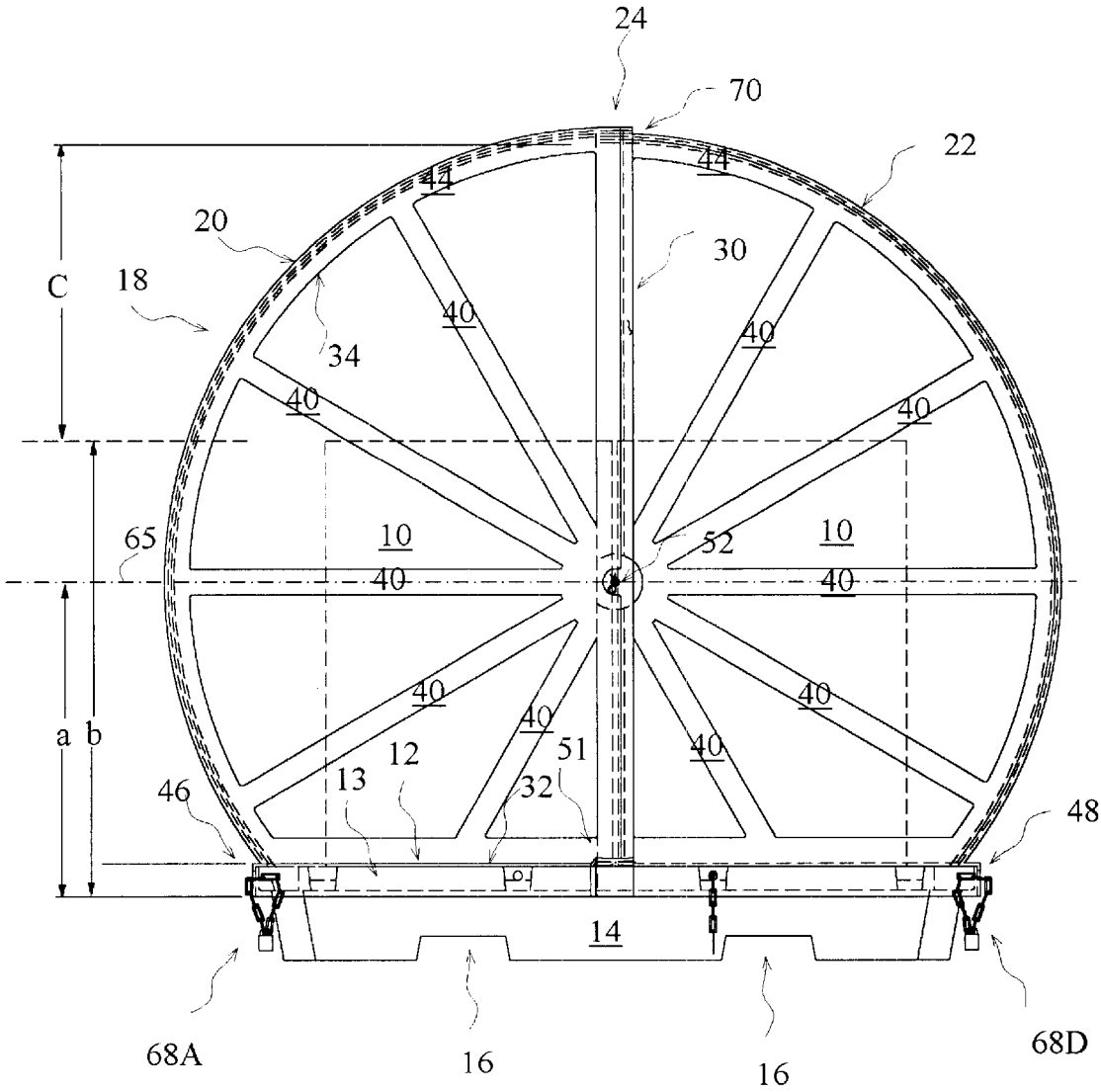
FIG. 1 is a side elevational view of the rotating-cover storage shed of the present invention with both sections of the rotating cover closed.

The present invention provides covered storage for drums of liquid material which are stored preferably in an upright orientation (longitudinal axis of each drum vertically oriented). Referring to FIG. 1, drums 10 are supported on a support surface 12 which preferably is on a grate 13 provided with a plurality of openings through which liquid, which might leak from drums 10, can flow toward a tray 14. The grate 13 is preferably supported by the tray 14 so as to have the support surface 12 in a horizontal orientation. The upright oriented drums are positioned on the support surface 12. A covered storage shed of the invention, which is of a convenient size, provides storage for 4 or 6 drums, each having a capacity of 55 gallons. Sheds having other capacities are also available.

The tray 14 to accommodate four 55 gallon drums, preferably has a capacity to contain the total content of at least one of the drums in the event that a leak occurs. In a preferred embodiment, recesses are provided, as indicated at 16, for insertion of fork lift tines for moving the storage shed. Such recesses can be provided on all four sides of the rectangularly shaped structure. In sheds accommodating more than 4 drums, insertion of fork lift tines from certain sides may not be recommended.

The tray 14, and the grate 13, are preferably fabricated of a non-corrosive plastic such as polyethylene.

Figure 2:
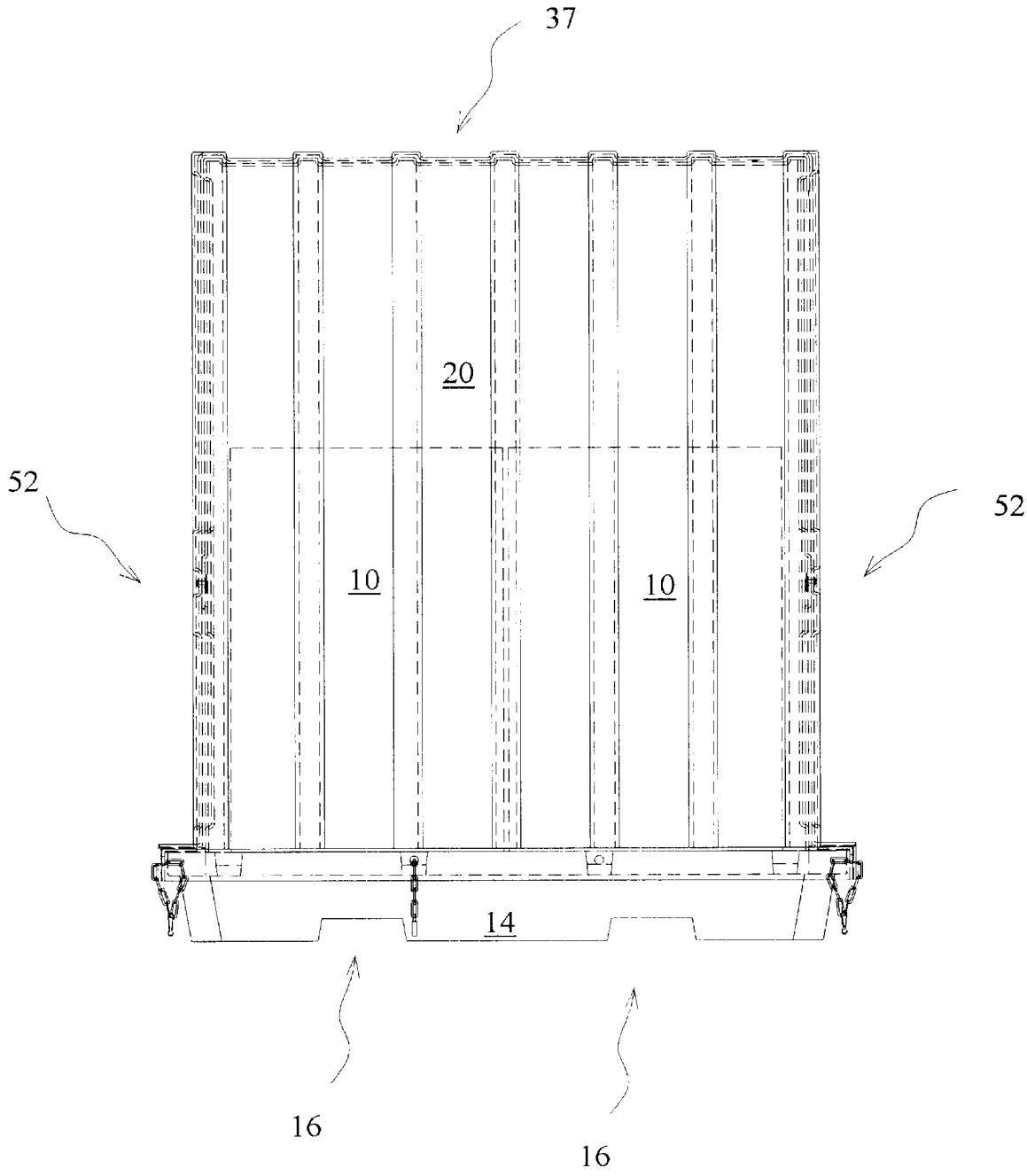
FIG. 2 is a front elevational view of the rotating-cover storage shed of the invention with both sections of the rotating cover closed.
Figure 3:
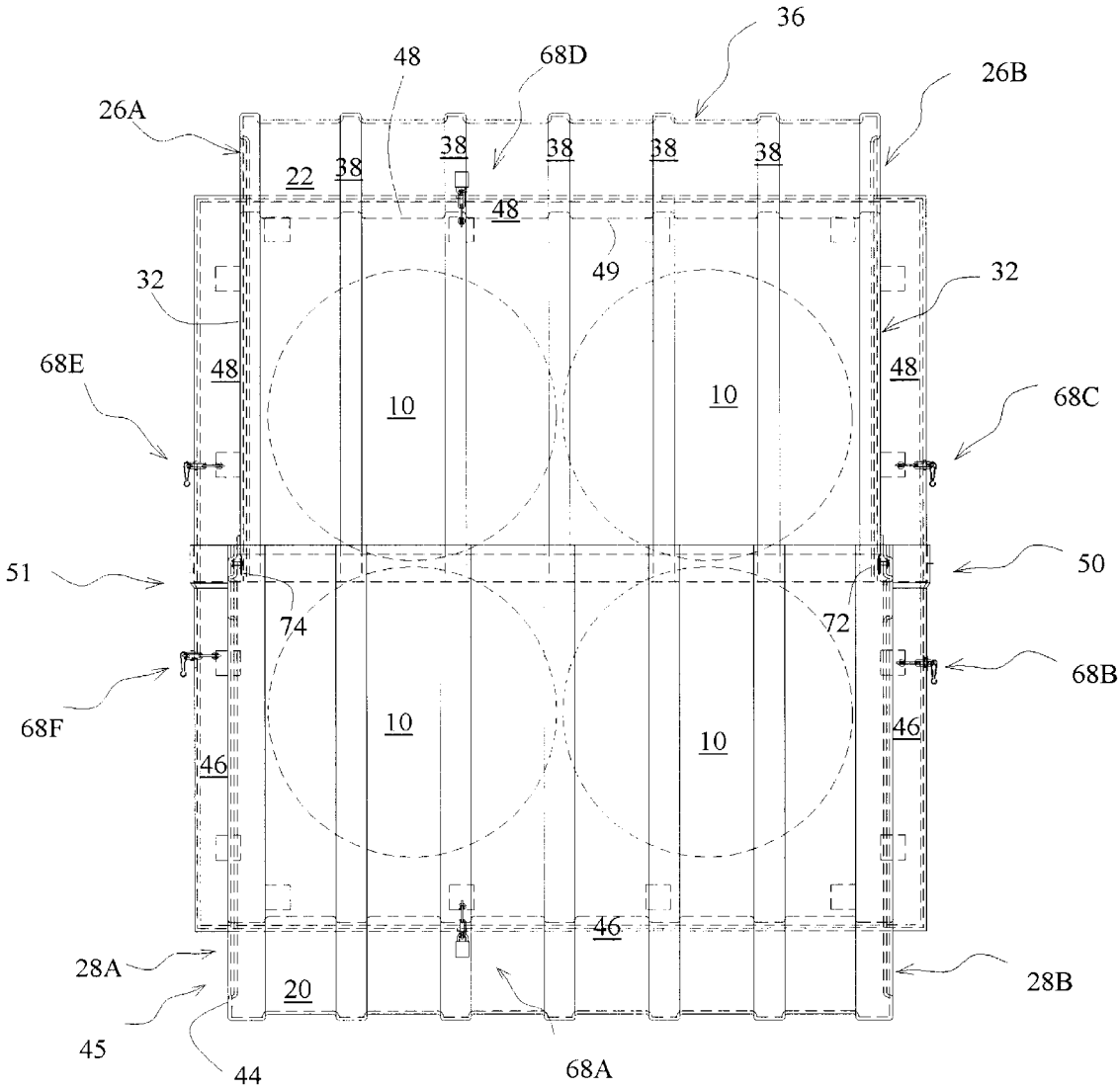
FIG. 3 is a top view of the rotating-cover storage shed of the invention with both sections of the rotating cover closed.

FIG. 2 shows the shed of the invention in a front view and FIG. 3 shows a top view of the shed. The embodiment of FIG. 3 provides storage for four drums, 10, however, modification of the shed to accommodate two, or more than four drums is easily accomplished and is discussed below.

In order to provide protection for the stored drums from the elements, when outside storage is desired, or to provide protection from unauthorized access to the drums, a cover generally indicated at 18 of FIG. 1, is provided over the drums so as to completely enclose the drums.

The cover is made up of two sections 20 and 22. The two sections are similar in shape, however, one of the sections, 22, is slightly smaller so as to be capable of having a telescoping arrangement inside section 20. Access to stored drums is accomplished by opening solely one of the covers (20, 22) at a time. FIG. 1 depicts the rotating-cover shed with the covers in a closed condition in order that the contents of the shed are fully enclosed by cover 18, consisting of section 20 and section 22. The overlapping or telescoping arrangement is indicated at 24.

Figure 4:
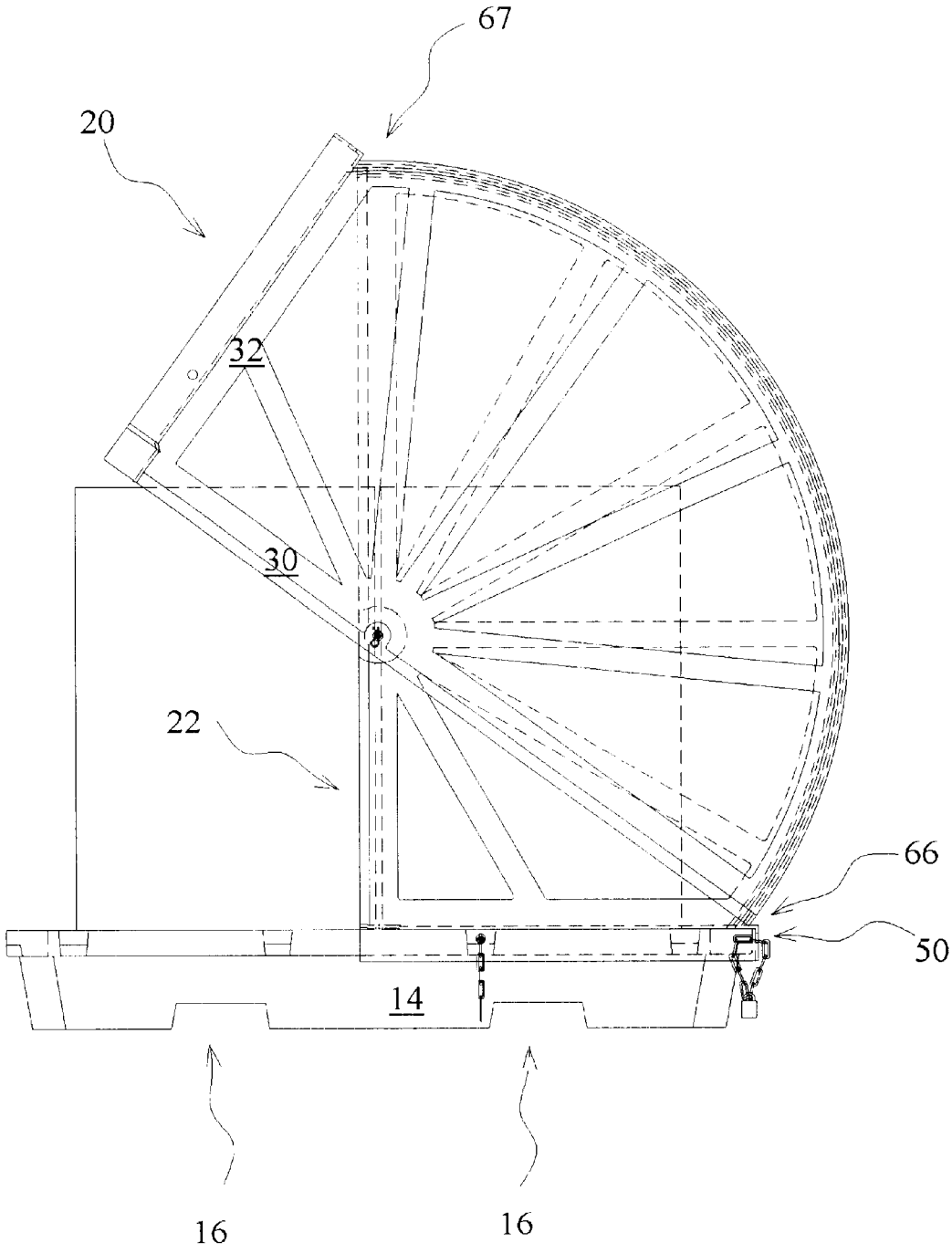
FIG. 4 is a side elevational view of the rotating-cover storage shed of the invention with an inside telescoping section of the rotating cover in an opened position.

FIG. 4 depicts one of the cover sections, 20, in a fully open condition wherein cover section 20 overlaps, in a telescoping arrangement, a large portion of cover section 22. A 180° rotation of a cover section is not necessary to reach the fully open condition and full access to the contents of the shed. In a preferred embodiment, a rotation of about 126° opens a cover section fully.

Each cover is made up of a pair of matching end panels arranged opposed and parallel to each other. Referring to FIG. 3, cover section 22 has end panels 26A and 26B, and cover section 20 has end panels 28A and 28B. As best viewed in FIG. 1, the periphery of each end panel is defined, in part, by two connected legs, for example 30 and 32 of cover 20. The legs have a right angle relationship to each other. An arcuate section 34 connects the remaining ends of the legs to complete the periphery.

An arc-shaped panel extends between each pair of end panels, for example arc-shaped panel 36 extends between end panels 26A and 26B of cover 22 (see FIG. 3). The arc-shaped panels are preferably ribbed so as to provide strength to the cover sections. Ribs 38 are indicated in FIG. 3 on cover 22. The ribs preferably are formed by offsetting the material of the panels to form ridges as shown at 37 of FIG. 2. By configuring the ribs of the inner cover section 22 and the outer cover section 20 so that the ribs nest, a smaller gap is needed between the telescoping cover sections resulting in a more weather-tight storage shed. The paired end panels of each cover section are only connected along the arc-shaped portion 34 of the periphery. No material extends between the leg portions 30, 30 or 32, 32 of the end panels. The arc-shaped panels can be of a solid material so as to provide protection to stored drums when an outside storage location is desired, or, the material of the arc-shaped panels can have perforations to provide ventilation for the shed when solely protection from unauthorized access to the drums is desired and protection from the elements is not a concern.

The end panels 26A, 26B, 28A and 28B of the cover sections can also be of a solid or perforated construction. In a preferred embodiment, to achieve more rigidity, each end panel has spoke-like ribs 40 (FIG. 1) extending from a reinforced hub 42 to a reinforced peripheral rib 44. The ribs and reinforced hub can be achieved by either a thicker material in those areas or by offsetting the material to form a ridge such as at 45 of FIG. 3 for forming peripheral rib 44.

Each cover is preferably fabricated of polyethylene which is rotomolded as a single piece.

Although the rotating cover is described in combination with the tray 14, for use in storing drums as discussed above, the rotating cover of the invention can stand alone on a substantially flat surface or be positioned on a base of any sort. For example, in the stand-alone application the rotating cover could be used for providing protection from the elements for equipment, recreational vehicles, building materials, or the like.

Further description of the rotating cover is directed to use with a tray for containing a liquid so as to provide a storage shed for drums of material requiring protection to the environment in the event of drum leakage.

When the cover sections are in a closed condition (FIG. 1) each cover section 20, 22 is supported by the tray 14. In the preferred embodiment, an external lip 46 is provided on cover 20 and an external lip 48 is provided on cover 22 (FIGS. 1 and 3). Each lip is preferably "L" shaped in cross-section with the "L" having an inverted orientation. Using cover section 22 of FIG. 3 as an example, external lip 48 extends from legs 32, 32 and also from a straight edge 49 of the arc-shaped panel 36. The external lip is continuous and forms a "U" shape as viewed in a top view with the cover in a closed condition, as in FIG. 3. Preferably the horizontal portion of the external lip rests on a top peripheral edge of the tray 14 when the cover section is in a closed condition, and the vertical portion of the lip extends downwardly to overlap an upper portion of sides of the tray 14 (see FIG. 4 at 50). Such an arrangement positions the cover properly on the tray, 14, and provides protection to the stored drums from the elements by directing rain water, for example, off the cover and down the sides of structure 14.

As mentioned above, cover section 20 is slightly larger than cover section 22 in order to accommodate the telescoping arrangement. In light of such difference in size, a slight offset in the external lip 46 is provided, as best viewed at 51 of FIGS. 1 and 3, so as to accommodate the lip of cover section 22 which is positioned inside the lip of cover section 20 when both cover sections are closed. The offset must be sufficient to also allow for a slight downward movement of the overlapping lip when cover section 20 is being opened, which is a result of the pivot point being removed slightly from edge 30. For the same reason, the horizontal portion of lip 48 of cover section 22 is offset upwardly away from its contact with tray 14 at the overlap area, depicted at 51.

Figure 5:
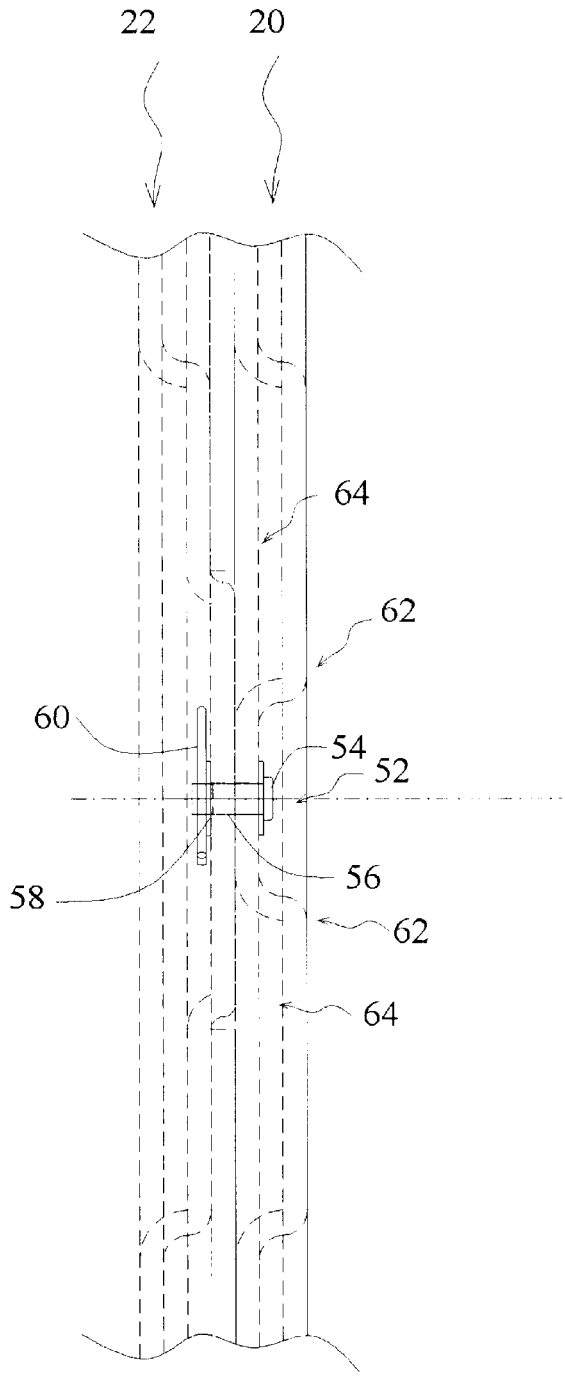
FIG. 5 is an enlarged sectional view of a pivot connection between two sections of the rotating cover of the rotating-cover storage shed of the invention.

In order to provide for the rotation of either cover section, 20 or 22, a pivot means, such as pivot pin 52, extends horizontally through both cover sections. Referring to FIGS. 1 and 5, pivot pin 52 is located near the edge of each cover section along leg portions of the end panels, for example leg portion 30 of cover section 20. Each pivot pin, as best viewed in the detailed drawing of FIG. 5, has a head 54 and a shaft 56. A washer 58 is positioned over shaft 56 and held in place by a retaining pin 60, such as a clevis pin or a cotter pin. In order to add strength to the area incorporating the pivot pin, end panels 26A, 26B and end panels 28A and 28B can be offset to form ridges as depicted at 62 and 64 respectfully of FIG. 5, or the thickness of the material can be increased in this area (not shown). The vertical location of the pivot pin, along edge 30, is on a horizontal line which would bisect an imaginary circle that would be formed by extending the arc-shaped edge of either end panel of the cover sections. In FIG. 1, interrupted line 65 represents such a horizontal line. Horizontally, the location of the pivot pin is approximately centered on the overlapping area of the cover sections, which is preferably between 2–4 inches in width. The height of the pivot pin above the support surface (or the edge of an end, such as edge 32 of cover section 20) is, at a minimum, equal to one-half the height of the tallest drum of material which is to be stored. Referring to FIG. 1, dimension "a" must be greater than one-half of dimension "b" (the height of a drum). A dimension "a" less than that value would result in interference between the cover and a top rim of a drum if that drum were positioned near an edge of the support surface.

The minimum height described above may not allow sufficient clearance for accessories for the drums, such as pumps and the like, which in some facilities may be left in place on the drums during storage. A dimension of about 23 inches above the support surface (dimension "a") for pivot pin 52 is preferred. With such a pivot pin location, a clearance of about 24 inches is provided above the drums. That clearance is indicated by the dimension line having a value c in FIG. 1.

In operation of the rotating-cover storage shed, to gain access to its contents, solely one cover section is opened at a time. The selection of which cover section to open is dependent on the location of the drum of interest or the location in which a drum is to be placed.

When either of the cover sections is being opened, the cover section being opened is supported entirely by the closed cover section, with support being carried out through the two pivot pins. A cover section is fully opened when an edge of the arc-shaped panel contacts a portion of the tray or support surface as depicted at 66 of FIG. 4. Also at such time, the external lip of the cover section being opened contacts the top of the closed cover as depicted at 67. Because of the distribution of the weight of the opened cover section about the pivot pin, the opened cover section remains stably open. When a cover section is fully opened, access to a drum on the opened side of the shed is unobstructed vertically above the drum as no material is present between legs 32, 32 and 30, 30 of the end panels of each cover section (see FIG. 4).

In order to provide security from unauthorized access to stored material and to prevent the cover from being blown off the tray during windy conditions, especially when one cover section is open, attachment means are provided between the rotating covers and the tray as depicted in FIG. 1 at 68 A, C and D and in FIG. 3 at 68 A, B, C, D, E and F. Any suitable means to carry out the attachment is possible, such as a link chain and padlock, or the like, passed through apertures in the cover and tray.

In situations where protection from the elements is critical, the stored material can be further protected with the use of a gasket between the overlapping portions of the two cover sections 20 and 22. An end view of a top gasket 70 is shown in FIG. 1, and an end view of side gaskets 72 and 74 is shown in FIG. 3. A preferred gasket is of closed cell foam rubber having an adhesive backing.

As mentioned above, the rotating cover storage shed can have a size to accommodate two or more drums. To increase or decrease the capacity of the four drum storage shed, only the distance between end panels 26A, 26B, and 28A and 28B need be increased or decreased, and a suitably sized tray and support surface be provided.

While specific materials, dimensional data, and configurations have been set forth for purposes of describing embodiments of the invention, various modifications can be resorted to, in light of the above teachings, without departing from the applicant's novel contributions, therefore in determining the scope of the present invention, reference shall be made to the appended claims.

What is claimed is:

1. A rotating-cover storage shed for storing a plurality of drums which contain a liquid material potentially hazardous to the environment, comprising a rectangular support surface arranged for supporting drums stored with an upright orientation a tray positioned below said support surface, for containing liquid material leaked from said stored drums, and an openable cover, supported by said tray and enclosing said stored drums when said cover is closed, wherein said cover is rotatably openable to provide access to said stored drums from the directions of two opposed edges of said rectangular support surface, said cover has two rotatable sections configured to pivot one section on the other section and to have a telescoping arrangement to each other, and when one rotatable section is being rotatably opened, it is supported solely by the remaining rotatable section, which is maintained closed.

2. A rotating-cover storage shed according to claim 1, further comprising attachment means for attaching said cover sections to said tray.

3. A rotating-cover storage shed according to claim 1, wherein each said cover section has a pair of matching end panels arranged to be opposed and parallel to each other, each end panel has a periphery comprised of two connected legs having a right angle relationship to each other and an arc connecting the two remaining ends of the legs, each said cover section has an arc-shaped panel extending between the arc shaped periphery of its pair of matching end panels, and one of the cover sections is larger than the other cover section so as to provide for said telescoping arrangement.

4. A rotating-cover storage shed according to claim 3, further comprising a pair of pivot pins pivotally connecting the two cover sections.

5. A rotating-cover storage shed according to claim 3, wherein each said arc-shaped panel incorporates reinforcing ribs, and each said end panel incorporates reinforcing ribs at a hub area, a peripheral area, and spoked areas connecting the hub and peripheral areas.

6. A rotating-cover storage shed according to claim 5, wherein said reinforcing ribs are portions of the panels offset to form ridges.

7. A rotating-cover storage shed according to claim 3, further including an external lip on each cover section for locating and supporting the cover on the tray.

8. A rotating-cover storage shed according to claim 7, wherein said external lip has an inverted "L" shape cross-section with a horizontally oriented portion supporting the cover on the tray and a vertically oriented portion maintaining the location of the cover on the tray.

9. A rotating-cover storage shed according to claim 3, further including a gasket between overlapping telescoping portions of the cover sections when in a closed arrangement.

10. A rotating-cover storage shed according to claim 1, wherein said cover sections are fabricated of polyethylene.

11. A rotating-cover storage shed according to claim 1, wherein said cover sections are fabricated of a plastic with a thickness between ⅛ and ¼ inch.

* * * * *